US006017071A

United States Patent [19]

Morghen

[11] Patent Number: 6,017,071

[45] Date of Patent: Jan. 25, 2000

[54] SWIVELING HOIST ASSEMBLY

[76] Inventor: Manfred A. Morghen, 6924 Hyde Park Dr., San Diego, Calif. 92119

[21] Appl. No.: 08/971,644

[22] Filed: Nov. 17, 1997

[51] Int. Cl.[7] ..... B66C 1/66

[52] U.S. Cl. ..... 294/94; 294/89; 294/1.1; 403/79; 403/164

[58] Field of Search ..... 294/1.1, 82.1, 294/82.15, 89, 94; 403/28, 29, 164; 411/400, 401–403, 384, 388

[56] References Cited

U.S. PATENT DOCUMENTS

| | | | |
|---|---|---|---|
| 4,017,115 | 4/1977 | Holt et al. | 294/89 |
| 4,431,352 | 2/1984 | Andrews | 410/101 |
| 4,630,982 | 12/1986 | Fenner | 411/400 |
| 4,705,422 | 11/1987 | Tsui et al. | 403/78 |
| 4,863,205 | 9/1989 | Schron et al. | 294/94 |
| 5,286,130 | 2/1994 | Mueller | 403/79 |
| 5,743,576 | 4/1998 | Schron, Jr. et al. | 294/1.1 |

*Primary Examiner*—Christopher P. Ellis
*Assistant Examiner*—Paul T. Chin
*Attorney, Agent, or Firm*—Frank D. Gilliam

[57] ABSTRACT

A hoist assembly having a swiveling head with a pivoting shackle. A lift swivel is captured by a housing and is rotatable relative to the housing. A shackle assembly including a hoist ring is fastened to the lift swivel. A lift bolt is threaded into the housing opposite the shackle assembly. The lift bolt includes an axially extending shaft for threading into a corresponding hole in a structure to be lifted. The end of the shaft in the hole is expandable to lock the shaft in the structure hole. A retainer such as a snap ring, or a jam ring and setscrews may be provided to securely lock the lift bolt to the housing. The lift bolt is threaded into the housing by a tool extending through the lift swivel or from the opposite end.

18 Claims, 1 Drawing Sheet

SWIVELING HOIST ASSEMBLY

FIELD OF THE INVENTION

This invention relates in general to hoist ring assemblies for lifting large, heavy, structures that can be securely mounted on structures and easily removed.

BACKGROUND OF THE INVENTION

A very wide range of devices have been developed to permit safe lifting of very large structures during manufacture or installation, such as large aircraft subassemblies, ship hull panels, large machines or machine components, etc. These devices range from simple eyebolts through shackles to hoist rings and custom clamps. Extreme care must be used in selecting and using a hoisting device for a particular structure. Breaking a lifting device through misuse or overloading can allow a multi-ton structure to fall, with severe damage to the structure and the surrounding area, in addition to possible severe injuries to workers.

Simple eye bolts and similar connections are only suitable with a lift line lying precisely along the length of the bolt. Any side loading is likely to result in catastrophic failure of the bolt. Because of this, shackles that pivot in one plane are used where the load direction may vary along a single plane. Shackles are often used with chain or rigging lines to attach fittings or to suspend a line. Where the load direction will vary in one plane, a hinged hoist ring may be used to accommodate the changing load direction. Typical of such hoist rings is that disclosed in U.S. Pat. No. 4,557,513. These hoist rings cannot, however, accommodate loads from any direction other than along the hinging plane.

When large, irregularly shaped structures such as aircraft panels or ship hull panels must be lifted, the lift load line will be in a direction well away from the fitting attachment bolt centerline and may vary in several different directions during the lift. Fully swiveling hoist rings, typically having rotating bases with a hinged ring, are used in such applications. Typical of such swiveling rings are those described in U.S. Pat. Nos. 3,297,293 and 4,705,422. These rings are very useful within their lift weight ratings.

Present swiveling lift rings, such as those described in the mentioned patents, tend to be complex and heavy and to have relatively low safe-load ratings. The separately installed shoulder pins and rings used as a unit often do not have the required load rating. Most are fastened to the structure to be lifted by a single bolt. In some applications it is desirable, as an additional safety measure, to attach the hoist ring assembly to the structure by two or more bolts while retaining the full swiveling and pivoting capability. A hoist ring assembly must fully and safely satisfy load and stress strength requirements from various angles and directions and under often adverse conditions.

Thus, there is a continuing need for improved hoist assemblies that are more versatile, have higher load ratings without excessive weight, will not accidentally detach, can be installed more quickly and are simple and inexpensive to manufacture and use.

SUMMARY OF THE INVENTION

The above-noted problems, and others, are overcome in accordance with this invention by a hoist assembly comprising a housing, a lift swivel captured by the housing for rotation about an axis relative to the housing and extending in a first direction along the axis from the housing, shackle means secured to said lift swivel, a lift bolt having a round head threaded into said housing and having a shaft extending from the housing along the axis in a second direction opposite the first direction, the shaft having threads for threading into a structure.

Thus, the shaft can be threaded into a structure to be lifted and a cable from a crane or the like can be secured to the shackle for lifting the structure. The shackle and lift swivel can swivel over a full 360 ° about the axis to automatically orient the load in any direction during lifting.

Preferably, the lift bolt head is tightened into the housing by means of a tool such as an Allen wrench or the like extending through an axial hole in the lift swivel to a corresponding socket in the lift bolt head. For maximum security, a securing member may be provided adjacent to the distal side of the lift bolt head to prevent the lift bolt head from unscrewing in use. Typically, the securing member could be a snap ring installed in an internal groove in the housing adjacent to the lift bolt head to improve assembly shear strength. Alternatively, a ring-shaped member having outer edge threads configured to screw into the housing internal threads to jam against the distal side of the lift bolt head may be used. The ring-shaped member may typically have two spaced holes for engagement by a spanner for threading the member into and out of the housing.

In order to positively lock the lift bolt shaft in a hole in a structure, preferably the distal end of the shaft has a central axial threaded opening with a plurality of longitudinal slits through the shaft between the opening and the shaft exterior. The threaded opening is tapered so that a setscrew or the like threaded into the opening will cause the shaft to expand into tight contact with the structure opening. The shaft opening preferably can be entered from either end by an Allen wrench or the like to engage the setscrew for rotation to lock or unlock the shaft from the structure hole.

Any suitable shackle may be secured to the lift swivel by any suitable means. Conventionally, a shackle may be generally U-shaped, with legs that fit over opposite sides of the lift swivel distal end. A transverse hole through the shackle legs and the lift swivel receives a transverse shackle bolt.

While it is generally preferred to install the housing with the lift swivel and lift bolt on a structure, then installing the shackle, if desired a transverse hole may be provided through the shackle bolt so that an Allen wrench or the like may be inserted through the shackle bolt and lift swivel to tighten the lift bolt head as described above.

For optimum security, the threads on the lift bolt head will be one hand, e.g. left hand, and the threads on the lift bolt shaft will be the opposite hand, i.e., right hand.

If desired, for additional security, a plurality of setscrews may be inserted through the housing, transverse to the axis, into engagement with the edges of the lift bolt head. Also, a cotter pin or the like could be installed outboard of the shackle bolt nut to prevent unthreading in use.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
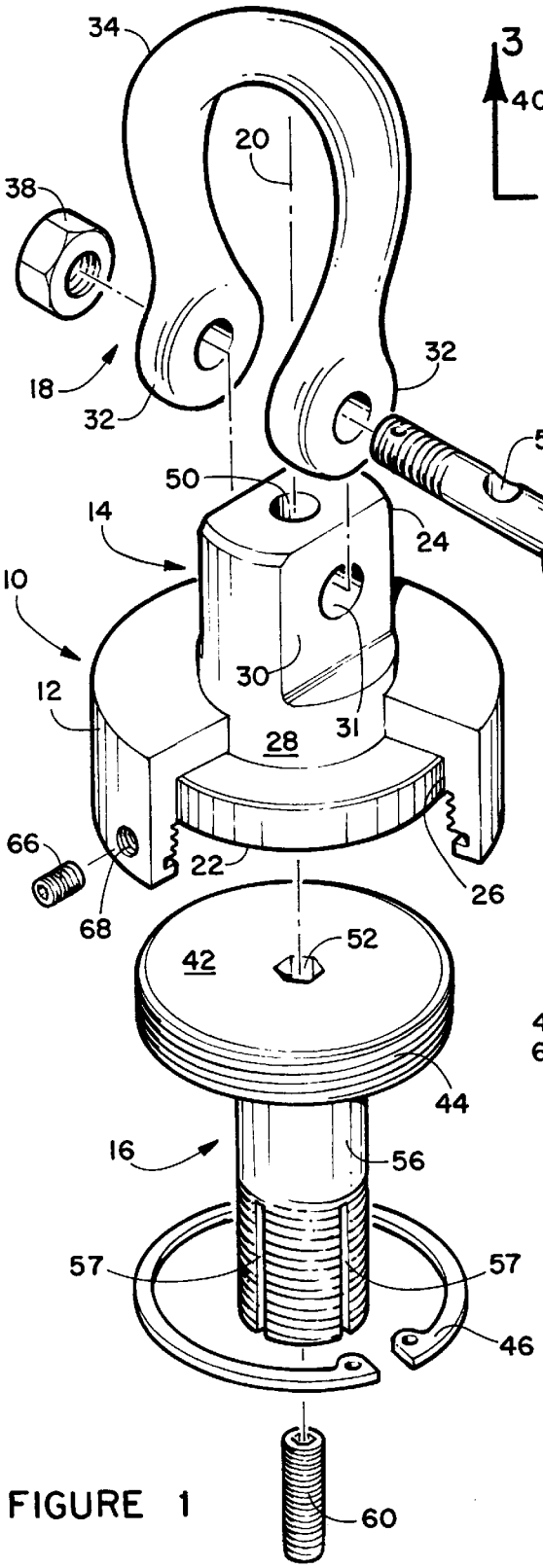
FIG. 1 is a perspective view of the hoist ring assembly of this invention.
Figure 2:
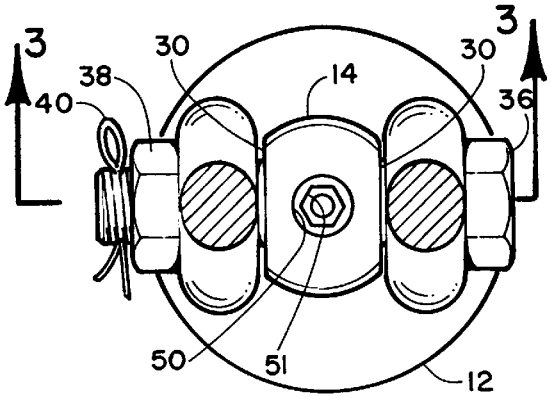
FIG. 2 is a transverse, downward looking, section view through the hoist ring assembly, taken through the hoist ring.
Figure 3:
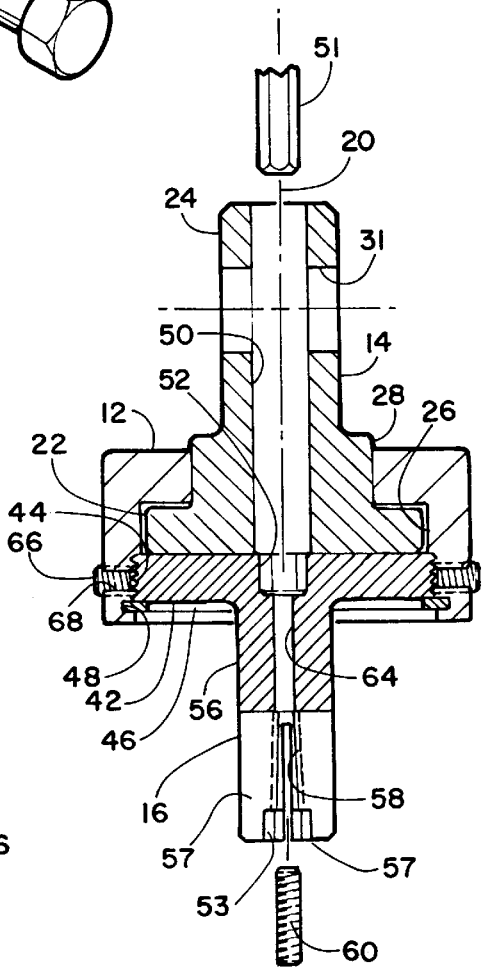
FIG. 3 is an axial section view through the hoist ring assembly, taken on line 3—3 in FIG. 2.

As seen in the Figures, the hoist assembly 10 is for use in lifting very large, heavy, structures with a crane or the like. The basic components of the assembly are a housing 12, a lift swivel 14, a lift bolt 16 and a shackle means 18, all lying along an axis 20.

Lift swivel 14 includes a proximal end in the form of a disk 22 and a distal end 24. The two end portions are preferably machined as a single unit, although two components could be secured together, such as by welding, if desired. Distal end 24 extends out of housing 12 through a circular hole 26. Circular rim 28 is preferably a loose fit in hole 26. The upper portion of distal end 24 preferably has flat opposite sides 30 for engagement with legs 32 of generally U-shaped shackle 34.

A bolt 36 extends transversely through an opening 31 in distal end 24 and legs 32 to secure shackle 34 to the distal end. A nut 38 is provided on bolt 36, with a cotter pin 40 or the like to assure that the nut cannot work off of the bolt when the assembly is in use.

Lift bolt 16 comprises a head 42 having peripheral threads 44 for threading into corresponding threads within housing 12. Preferably, a retaining means, such as removable snap ring 46 seated in a groove 48 in housing 12 adjacent to the fully inserted head, is provided to prevent head 42 from working out of housing 12 while the assembly is in use. Alternatively a ring-like disk could have outside threads for threading into housing 12 to jam against head 42.

In order to thread lift bolt head 42 into housing 12, an axial opening 50 is provided through lift swivel 14 to a socket 52 in the distal surface of head 42. A suitable tool 51, such as an Allen wrench, screwdriver, a straight hexagonal rod attached to a torque wrench or other similar device, may be inserted through opening 50 into engagement with socket 52 of appropriate configuration to rotate lift bolt 16 and thread head 42 into or out of housing 12. If this installation is done before shackle assembly 18 is installed, the tool is simply inserted into opening 50. If shackle assembly 18 is already installed, a transverse opening 54 is formed in bolt 36 in alignment with opening 50 so that shackle 34 can be folded to one side and the tool inserted through openings 50 and 54.

A socket 53 may also be provided at the distal end of shaft 56 so that Allen wrench 51 could thread head 42 into and out of housing 12 from the lower end of the assembly.

Lift bolt 16 includes a shaft 56 extending axially from head 42. Lift bolt 16 may be machined integrally with head 42 or separate components may be assembled, such as by welding.

The exterior of shaft 56 is threaded to thread into a correspondingly configured hole in a structure to be lifted. The thread on head 42 may be the opposite hand to the thread on shaft 56, because this will provide an additional lock/jamming effect against snap ring 46 or the like for optimum security.

To further lock shaft 56 within a structure hole and prevent unthreading while in use, a tapered, threaded, axial hole 58 is formed in the distal end of shaft 56. The hole narrows toward head 42. Along the distal shaft end a plurality of longitudinal slits 57 are formed through the wall between opening 58 and the shaft exterior to provide transverse flexibility to the wall. Typically, 3 to 5 spaced slits 57 are provided. A setscrew 60 is partially threaded into axial hole 58, without expanding shaft 56, and the shaft is threaded into the structure hole. If desired, hole 58 could be tapered in the opposite direction and setscrew 60 could be inserted through hole 50 and opening 64.

Where the end of shaft 56 is exposed, a tool such as an Allen wrench may be inserted through socket 53 into a corresponding socket in the lower end of setscrew 60 to thread the setscrew further into the tapered opening 58, expanding the distal end of shaft 56 into tight engagement with the wall of the structure opening. Where the lower end of shaft 56 is not exposed, a tool can be inserted from above, through opening 50 and extended opening into engagement with a socket appropriate to the tool used in the upper end of setscrew 60 and the setscrew is rotated to expand the distal end of shaft 56 as described above.

To further assure that head 42 cannot rotate relative to housing 12 during use of the assembly, a plurality (typically 3–5) of setscrews 66 can be threaded into holes 68 into locking engagement with the periphery of head 42.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A hoist assembly which comprises:

a housing;

a lift swivel captured by said housing, having a distal end extending from said housing along an axis in a first direction and rotatable relative to said housing about said axis;

shackle means secured to said lift swivel distal end;

a lift bolt having a head threaded into said housing adjacent to a proximal end of said lift swivel, said lift swivel having an axial opening therethrough to permit entry of a tool through said lift swivel to said head and means on said head for engaging said tool to permit said tool to rotate;

said lift bolt further having a shaft extending away from said head along said axis in a second direction opposite said first direction; and fastening means for fastening said shaft to a structure to be lifted.

2. The hoist assembly according to claim 1 wherein said shackle means comprises a generally U-shaped shackle ring having legs configured to fit along said distal lift swivel end and a bolt extending through said legs and said distal lift swivel end with said axial opening extending through said lift swivel and said bolt.

3. The hoist assembly according to claim 1 further including retainer means for releasably prevent unthreading of said head from said housing.

4. The hoist assembly according to claim 3 wherein said retainer means comprises a snap ring for inserting in a groove within said housing adjacent to a distal side of said head.

5. The hoist assembly according to claim 1 wherein said fastening means comprises threads along said shaft for threading into a correspondingly threaded hole in a structure to be lifted.

6. The hoist assembly according to claim 5 wherein said threads on said head and said threads on said shaft are of opposite hand.

7. The hoist assembly according to claim 5 wherein:

said fastening means further includes a tapered axial hole in the distal end of said shaft;

said tapered axial hole being wider toward said distal end of said shaft;

a setscrew for threading into said tapered axial hole;

at least one access opening through said assembly for a setscrew rotating tool; and a plurality of longitudinal slits through said shaft along said tapered axial hole;

whereby threading said setscrew into said tapered axial hole will expand said shaft distal end against walls of a threaded hole in a structure.

8. The hoist assembly according to claim 7 wherein said access opening comprises an extension of said axial opening through said head.

9. A hoist assembly which comprises:

a housing;

a lift swivel captured by said housing, having a distal end extending from said housing along an axis in a first direction and rotatable relative to said housing about said axis;

shackle means secured to said lift swivel distal end;

a lift bolt having an head threaded into said housing adjacent to a proximal end of said lift swivel;

an axial opening through said lift swivel to permit entry of a tool through said lift swivel to said head and means on said head for engaging said tool to permit said tool to rotate said lift bolt to thread and unthread said head into and out of said housing; and said lift bolt further having a threaded shaft extending away from said head along said axis in a second direction opposite said first direction for threading into a correspondingly threaded opening in a structure to be lifted.

10. The hoist assembly according to claim 9 wherein said shackle means comprises a generally U-shaped shackle ring having legs configured to fit along said distal lift swivel end and a bolt extending through said legs and said distal lift swivel end with said axial opening extending through said lift swivel and said bolt.

11. The hoist assembly according to claim 9 further including retainer means for releasably prevent unthreading of said head from said housing.

12. The hoist assembly according to claim 11 wherein said retainer means comprises a snap ring for inserting in a groove within said housing adjacent to a distal side of said head.

13. The hoist assembly according to claim 9 wherein said threads on said head and said threads on said shaft are of opposite hand.

14. The hoist assembly according to claim 9 wherein:

said fastening means further includes a tapered axial hole in the distal end of said shaft;

said tapered axial hole being wider toward said distal end of said shaft;

a setscrew for threading into said tapered axial hole;

at least one access opening through said assembly for a setscrew rotating tool; and a plurality of longitudinal slits through said shaft along said tapered axial hole;

whereby threading said setscrew into said tapered axial hole will expand said shaft distal end against walls of a threaded hole in a structure.

15. The hoist assembly according to claim 14 wherein said access opening comprises an extension of said axial opening through said head.

16. A hoist assembly which comprises:

a housing;

a lift swivel captured by said housing, having a distal end extending from said housing along an axis in a first direction and rotatable relative to said housing about said axis;

shackle means secured to said lift swivel distal end;

a lift bolt having a head threaded into said housing adjacent to a proximal end of said lift swivel;

an axial opening through said lift swivel to permit entry of a tool through said lift swivel to said head and means on said head for engaging said tool to permit said tool to rotate said lift bolt to thread and unthread said head into and out of said housing; and said lift bolt further having a threaded shaft extending away from said head along said axis in a second direction opposite said first direction for threading into a correspondingly threaded opening in a structure to be lifted;

a tapered axial hole in the distal end of said shaft;

said tapered axial hole being wider toward said distal end of said shaft;

a setscrew for threading into said tapered axial hole;

at least one access opening through said hoist assembly to permit a setscrew rotating tool to engage and rotate said setscrew;

a plurality of longitudinal slits through said shaft along said tapered axial hole; and a retainer means for releasably preventing unthreading of said head from said housing.

17. The hoist assembly according to claim 16 wherein said shackle means comprises a generally U-shaped shackle ring having legs configured to fit along said distal lift swivel end and a bolt extending through said legs and said distal lift swivel end with said axial opening extending through said lift swivel and said bolt.

18. The hoist assembly according to claim 17 wherein said retainer means comprises a snap ring for inserting in a groove within said housing adjacent to a distal side of said head.

* * * * *